US005103604A

United States Patent [19]

Teron

[11] Patent Number: 5,103,604

[45] Date of Patent: Apr. 14, 1992

[54] MODULAR BUILDING SYSTEMS

[75] Inventor: William Teron, Ottawa, Canada

[73] Assignee: Teron International (Bermuda) Limited, Bermuda

[21] Appl. No.: 503,387

[22] Filed: Apr. 2, 1990

Related U.S. Application Data

[63] Continuation of Ser. No. 227,633, Aug. 3, 1988, abandoned, which is a continuation of Ser. No. 93,716, Sep. 8, 1987, abandoned, which is a continuation of Ser. No. 725,796, Apr. 22, 1985, abandoned, which is a continuation of Ser. No. 162,501, Jun. 24, 1980, abandoned.

[51] Int. Cl.[5] ..... E04H 1/04; E04B 1/02; E04C 1/39

[52] U.S. Cl. ..... 52/79.14; 52/126.3; 52/221; 52/274; 52/284

[58] Field of Search ..... 52/79.14, 221, 279, 52/610, 274, 284, 126.3

[56] References Cited

U.S. PATENT DOCUMENTS

| | | | |
|---|---|---|---|
| 3,616,592 | 11/1971 | Rothman | 52/745 |
| 3,735,548 | 5/1973 | Ferrari et al. | 52/79.14 |
| 3,757,477 | 9/1973 | McCrillis et al. | 52/79.14 |
| 3,800,493 | 4/1974 | Livingston | 52/745 |
| 4,142,340 | 3/1979 | Howard | 52/602 |
| 4,195,453 | 4/1980 | Komendant | 52/79.14 |

FOREIGN PATENT DOCUMENTS

| | | |
|---|---|---|
| 1336456 | 7/1963 | France . |
| 2104967 | 4/1972 | France . |
| 2263359 | 10/1975 | France . |
| 2352136 | 12/1977 | France . |
| 2381870 | 9/1978 | France . |

*Primary Examiner*—Michael Safavi

*Attorney, Agent, or Firm*—Evenson, Wands, Edwards, Lenahan & McKeown

[57] ABSTRACT

A building module, modular building constructions and methods for erecting same are disclosed. The module is of deep U-shape configuration, defining a space which is able to enclose various facilities within a building structure. A typical module includes a raceway and internal conduit system for power and/or communications systems etc. Preset-levelling and self-centering devices provide for quick erection of the modules in a wide variety of arrays and configurations to provide exterior walls and to enclose and define interior space.

7 Claims, 11 Drawing Sheets

MODULAR BUILDING SYSTEMS

CROSS REFERENCE TO RELATED APPLICATIONS

The present application is a continuation-in-part application of application Ser. No. 227,633, filed Aug. 3, 1988, now abandoned, which is a continuation application of Ser. No. 093,716, filed Sept. 8, 1987, now abandoned, which is a continuation of application Ser. No. 725,796 filed Apr. 22, 1985, which is a continuation of U.S. patent application Ser. No. 162,501 filed June 24, 1980, now abandoned.

FIELD OF THE INVENTION

The present invention relates to improvements in construction modules, to building constructions utilizing such modules, and to improved methods for erecting buildings employing such construction modules.

BACKGROUND OF THE INVENTION

In sharp contrast to the rapidly developing technology in many other fields, construction technology has proceeded at a relatively slow pace over the last half-century. Although numerous techniques have been developed, these have not been adopted widely by the construction industry with the result that construction has remained labor intensive and of a handicraft nature. Accordingly, housing and building costs have remained very high.

Prefabrication has been cited as one of the potential answers to the problem, but many of the proposals to date have not proven to be commercially successful and relatively few prefabrication techniques have been adopted by the industry. Prefabrication techniques fall under two major categories, namely, light wood and aluminum frame prefabrication, and concrete or like product precasting. Wood and aluminum frame prefabrication is limited to low density suburban housing. Concrete prefabrication is more appropriate for urban buildings due to fire and structural safety requirements.

The majority of the concrete precasting prefabrication systems, many of which were designed in Europe, have not been commercially successful, particularly in North America. Most are structural systems and not housing or building systems. While structural i.e. walls, floors, they do not incorporate functional attributes related to housing building users' needs and architectural understanding. In addition to not being user or market oriented to any substantial degree, these known systems tend to be costly, requiring expensive prefabrication factories and relatively expensive handling and erection equipment and techniques. To be viable such concepts usually require a very high degree of repetition.

Most of the prior art concrete prefabrication systems follow one of three primary conceptual types, namely:

(1) a shear wall and floor plate design; primarily high rise, with the innovative part of the design being concentrated around the connection details. Erection usually requires shoring and bracing. These systems tend to produce a heavy structural box which has no particular relationship to any specific end use. These structures require finishing, further partitioning and outfitting with traditional add-on methods and equipment.

(2) a three-dimensional concrete box; like the shear wall system noted above, the use of the space within such stacked boxes is arbitrary and the end use and function has to be created by an add-on system of traditional finishes, partitions and equipment.

(3) on site systems of either large, portable forms for pouring in place, or wire cages and walls with the concrete sprayed on and then trowelled on-site. These systems do not require expensive factories and handling equipment; however, they do require skilled on-site labor and the system is capable of providing only the macro-space. All finishes and equipment must then be added in the traditional fashion.

A variety of patents have issued over the years relating to various types of prefabricated units or slabs intended to be assembled into a building or other structure. One common problem which remained largely unsolved was that they were closed systems with limited architectural flexibility and space flexibility.

Another form of building construction is a variation of type (1) above and involves the use of shear walls of shallow U-shaped cross-section. Examples of patented processes and construction module configurations of this type are described in U.S. Pat. No. 3,952,471 to Mooney, and U.S. Pat. No. 4,142,340 to Howard. The Mooney patent essentially discloses a building structure having a series of vertical precast combination foundation wall and side wall panels of shallow U-cross section supported on a footing at spaced apart intervals. This structure includes in-fill panels with cast-in windows and doors. The in-fill panels are connected by welding between load-bearing vertical side edge flanges of the wall panels. This system provides only an exterior wall arrangement.

The building construction scheme described in the Howard patent employs a series of standard panels each having a shallow U-shape cross-section. The walls are formed by a series of such panels disposed vertically in side-by-side relationship. Because of their instability, as is the case of the Mooney panels, the panels must be temporarily braced during erection and then permanently connected to each other by fastener elements. In the Howard scheme, a plurality of side fastener elements which bridge the panels are employed. In essence, the Howard configuration involves an exterior wall system which works in conjunction with a predetermined roof system. A somewhat specialized footing is also required to provide for connection to the vertical exterior wall panels. In the construction arrangements described by both Howard and Mooney, neither module performs a volumetric, space enclosing function related to architectural requirements.

SUMMARY OF THE INVENTION

One object of the invention is to provide an improved building module which acts as a functional container responding to the users' functional requirements, which module allows the creation of custom designed solutions, which module is self-standing or self-supporting and can be readily provided with an internal power and/or communications network.

Another object of the invention is to provided an improved modular construction in which the basic modular unit is in the form of a U-shaped channel whose shape and proportion provides a multi-purpose functional container for enclosing housing or building users' appurtenances and facilities. It is a further object to provide a module which is structural (load bearing), and can be arranged to provide structural exterior and interior bearing walls as well as interior partitions.

The present invention provides a universal building construction module in the form of an elongated deep U-shape formed of a rear wall and two side walls, the module being one story in height when disposed end down on a concrete slab, the real wall of the module being sufficiently wide to span the major portion of a room, the width of the side walls of the module being sufficient with the rear wall to enclose on three sides and define the walls of a standard facility within the room while at the same time the side walls of said module form supports for the rear wall sufficient to cause the module to be free standing while devoid of lateral support.

The present invention also provides a building comprised of at least one room, the room having concrete walls formed of precast universal building construction modules each being in the form of an elongated deep U-shaped formed of a rear wall and two side walls, the modules being one story in eight and disposed end down on a concrete slab, the rear wall of at least one module being sufficiently wide to span the major portion of a room, the width of the side walls of each module being sufficient with the rear wall to enclose with three sides and define the walls of a standard facility within the room while at the same time the side walls of said modules form supports for the rear walls sufficient to cause the modules to be free standing, the modules also being devoid of mutual lateral support, and a roof element supported by said free standing building modules. The building can be of size from a single one room hut to a multi-story highrise. All use the same basic modules described herein.

The expression "standard facility" as employed herein is intended to include any of the standard appurtenances commonly used in residential building construction, including: kitchen counters, cupboards and appliances, bathroom counters, bathtubs, shower stalls, closets, fireplaces and the like.

The expression "module" as employed herein is also intended to include the case in which two U-shaped structures are located back-to-back and cast as a single unit, or two U-shaped structures of the kind described with a common rear wall.

Preferably the module contains an internal conduit system providing for multiple access points for junction boxes, electrical switches or electrical or other outlets at the major surfaces of the flanges and/or the major surfaces of the main panel of the module, with the distribution being so arranged as to allow electrical and telephone and/or cable and/or intercom to be wired in the module. The module may have a raceway, trough or groove cast in its top end to allow the connection of power or communication sources within the module and to allow module-to-module electrical or communications connections.

Preferred embodiments of the invention provide a flexible form of modular building construction which allows custom design solutions for a wide variety of building types either single, low or medium rise. The modules are small in size thus resulting in efficiency and economies in casting, transporting, erecting and connecting because of the elimination of the need for large or special factory or handling equipment. The self-standing modules can be erected quickly and directly and can incorporate levelling and centering means which may be positioned prior to placement of the modules thereby to further accelerate the building erection process and to provide accuracy of the placement of the modules.

Preferably the modular building system is an open system. It allows the use of the builders' choice of local standard windows, doors, roofs and other equipment. These local standard windows and doors are preferably set between the modules, although they can, if desired, be cast in the modules. Windows and doors set adjacent to the modules provide the advantage of connecting them to the modules on-site using standard connection details and further to provide the construction tolerances required. Moreover, the connection of building modules to each other, to floors and roofs, also requires only the use of standard on-site connection details and local practices.

The modules are designed to be of sufficient depth to define multi-purpose functional containers capable of enclosing or delineating kitchens, bathrooms, closets, fireplaces, bookshelves, buffets, etc., rooms of domestic proportions or any other appurtenances and facilities, in housing or filing, machines, storage retail shelving and show space for offices and retail buildings.

Preferably the module is of a height which is a multiple of the normal floor to ceiling height of residential and building constructions. In multi-story applications, such modules retain their structural, self-supporting and self-standing capabilities while serving as full height exterior wall systems or as interior wall systems of a demising nature. Such modules for multi-story applications desirably have the capability of using normal concrete inserts to support floors of prestressed/precast slabs, or floors of a wood or steel structure.

The modules can be made with final finished surface. The modules are cast in a single process. Normally, they are cast in an open steel mold, vibrated, and the non-formed surfaces trowelled. This produces a high quality final finish on all surfaces. The modules are thus ready for paint or wallpaper without further finishing. This eliminates the need for furring, gyprock, taping of gyprock joints or any other secondary wall surfacing. The modules have the above-noted electrical and communications conduits cast into them during this single process. The result is a module with finished walls with built-in infrastructure. The module may be cast in room heights of 8 feet or multiples thereof. Its' small size results in economy in casting, demolding, handling transportation and erecting. Moreover, its small size allows flexibility in design manipulation.

The number of sizes of modules required for maximum flexibility is small. The module can be of a greater number of sizes, these sizes dictated by its functional characteristics of responding to the user, being structural or load bearing and self-supporting. However, it has been found that 3 to 5 sizes of modules are required for wide flexibility of design. Where required, L-shaped modules can be made simply by blocking off a portion of the mold for a U-shaped module.

Previously, it was indicated that the modules' unique shape results in a self-standing or self-supporting characteristics. This allows the modules to be erected without scaffolds, shoring, etc. This characteristic is accentuated through the use of the above-noted levelling and centering means which facilitates quick and easy on-site erection. The bottom of a typical module is provided with bearing pads which mate with the centering and levelling means which are installed on the floor prior to the modules being erected. This system eliminates the need to constantly lift and adjust the module vertically and horizontally during erection. Rather the module can be lowered downwardly and positioned true and level in a single motion. Therefore, the erection process is significantly speeded up, and costly crane and equipment staff are utilized more efficiently. The need for skilled labor is greatly reduced as compared with traditional methods, this being a great advantage in regions where there is a shortage of skilled labor or where labor costs are exceedingly high.

BRIEF DESCRIPTION OF THE DRAWINGS

The various features and advantages of the invention will become more apparent from the following description of preferred embodiments of same wherein reference is had to drawings wherein.

DETAILED DESCRIPTION

Figure 1:
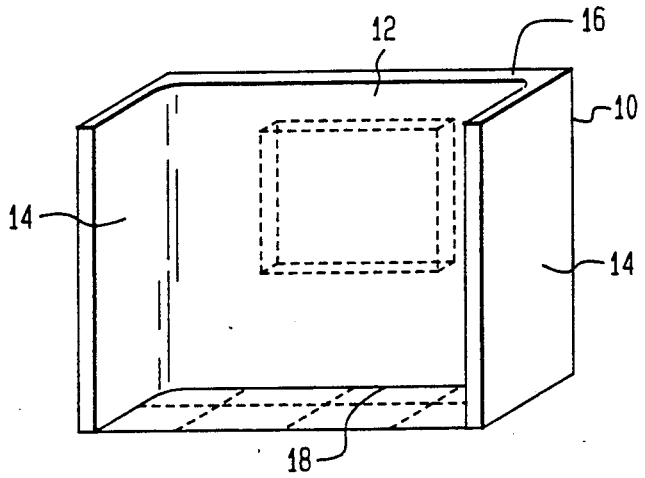
FIG. 1 is an isometric view of a typical module of U-shape configuration.
Figure 2A:
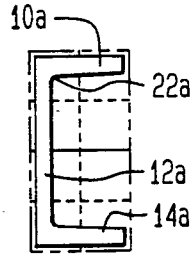
FIG. 2 is a plan view of a selected set of typical modules.
Figure 2B:
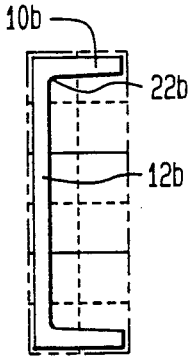
Figure 2C:
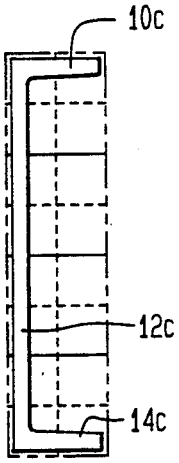
Figure 2D:
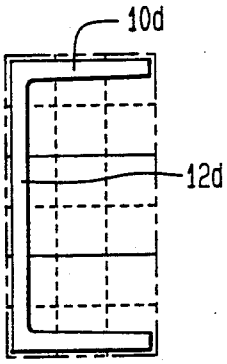
Figure 2E:
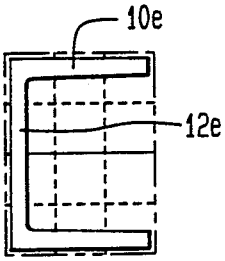
Figure 2F:
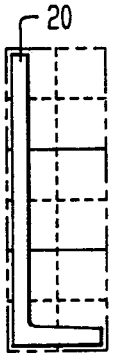
Figure 2G:
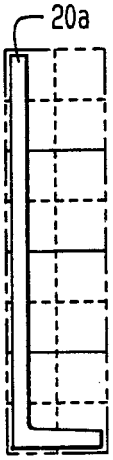

Referring now to FIG. 1, there is illustrated a typical construction module 10 comprising a precast concrete monolithic unit capable of being positioned in vertical self-standing relation on a horizontal support surface. The module includes a rectangular planar main panel or rear wall 12 having planar flanges or side walls 14 extending outwardly from each of the opposing side edges of rear wall 12 at right angles thereto, thereby defining with the latter a generally U-shaped configuration in plan. The opposed major surfaces of both the main panel 12 and flanges 14 lie generally in parallel to one another. The top and bottom ends 16 and 18 of the module lie in spaced parallel planes normal to the height.

As noted previously, a significant aspect of the present invention is the fact that the module is both self-standing and the interior U-shaped thereof defines a space enclosure for enclosing appurtenances or facilities within a building structure. These two features of the invention represent a significant advance over conventional modular approaches such as described in the above-referenced patents to Mooney and Howard, neither of which is capable of being free-standing or providing the appurtenance enclosure features of the invention. Because of the substantial depth of the U-shaped configuration of the module 10, as shown in FIG. 1, the module possesses an inherent mechanical stability, resulting from the location of its center of mass (or gravity) away from the interior of the rear wall or main panel 12 to the open space interior portion of the module between flanges or side walls 14. This shift of the center of mass outside of the interior of the rear wall or main panel 12 enables the module to withstand tipping forces, such as wind, construction personnel leaning against the walls, accidental bumping, etc. as contrasted with the inherently unstable configurations of the prior art, represented by the above-referenced Mooney and Howard patents.

Figure 1A:
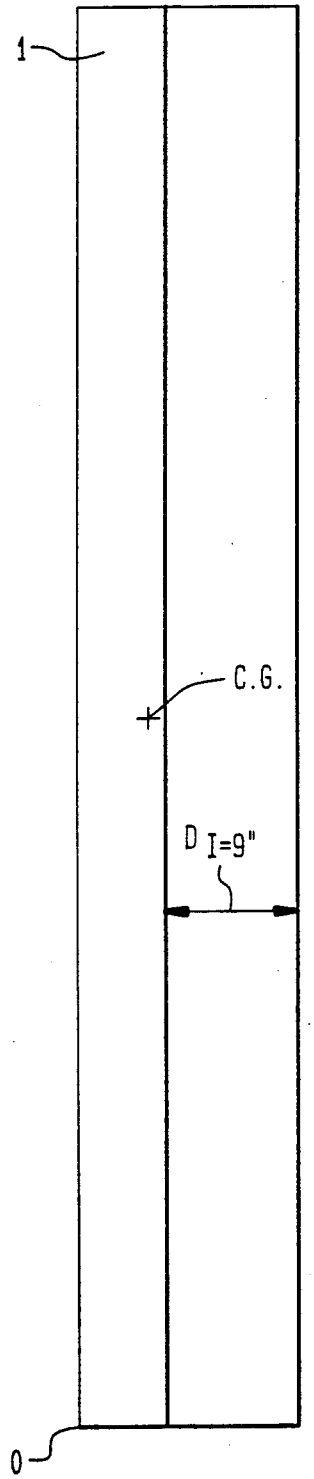
FIG. 1A (PRIOR ART)
FIGS. 1A and 1B are respective side and plan views of a shallow U-shaped module of the prior art.
Figure 1C:
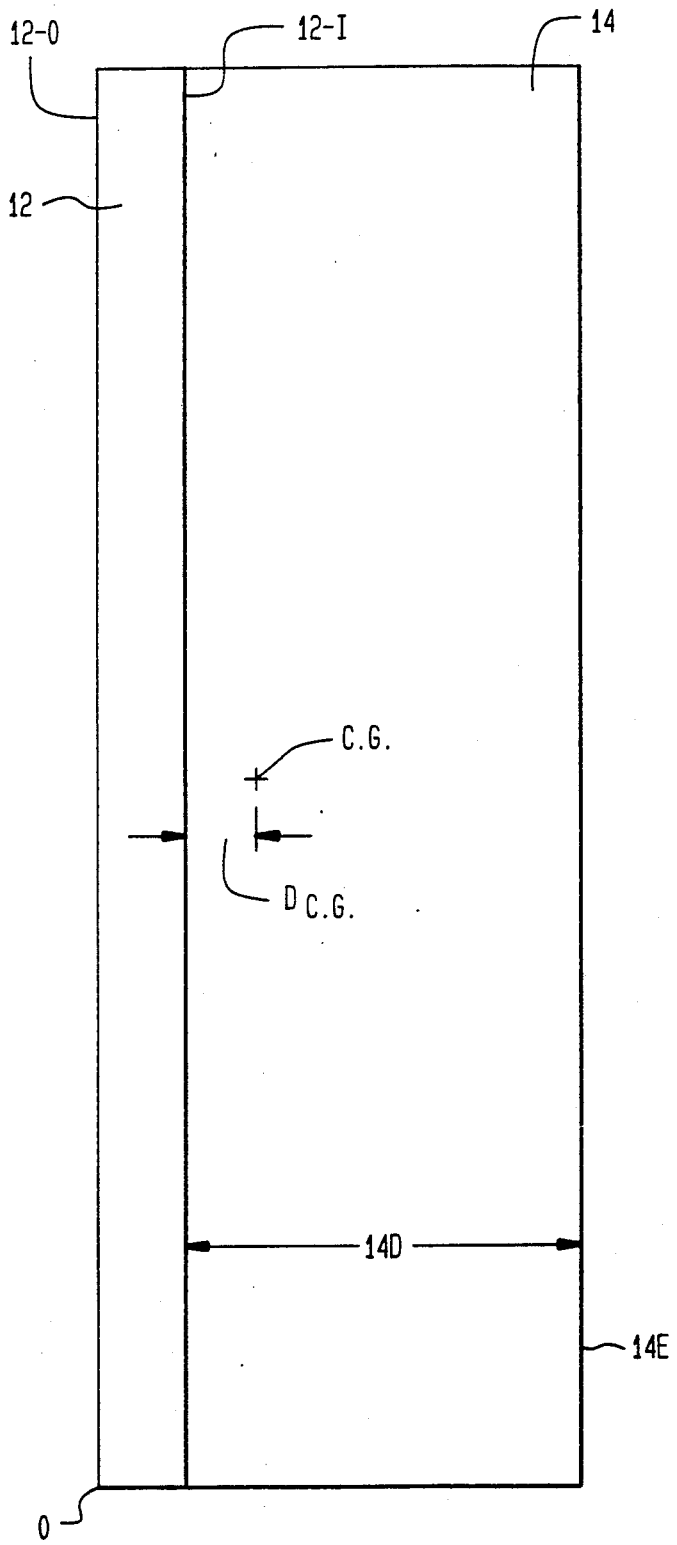
FIG. 1C is a side view of a typical module of U-shaped configuration in accordance with the present invention, an isometric view of which is shown in FIG. 1.
Figure 1B:
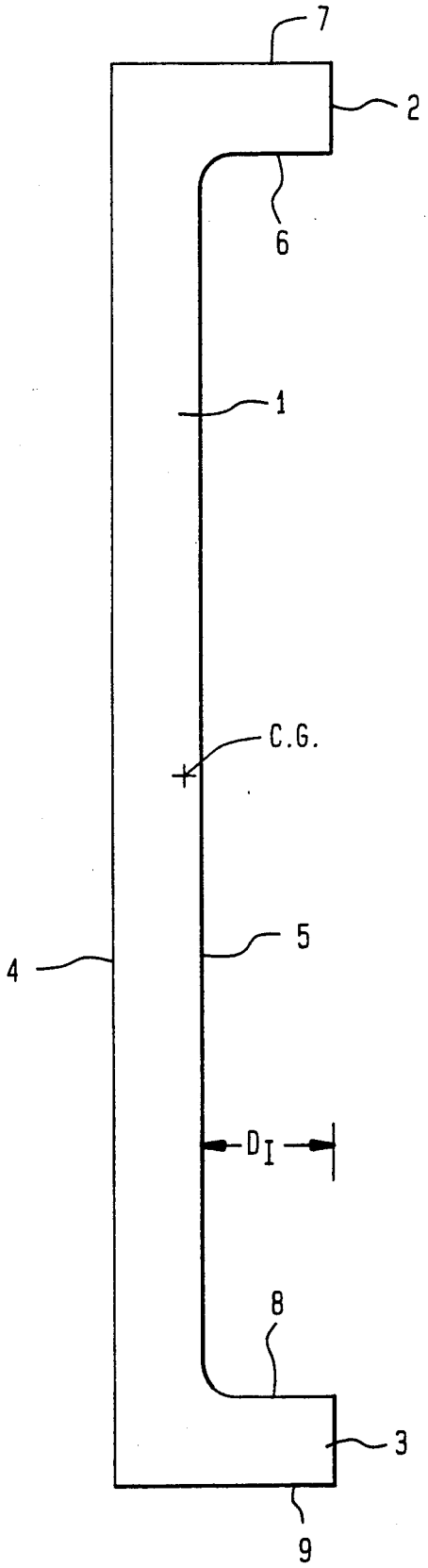

As an illustration of the significant contrast between the present invention and the prior art referenced above, attention is directed to FIGS. 1A through 1C of the Drawings, FIGS. 1A and 1B of which show respective side and plan views of the shallow U-shaped module of Howard and a side view of the relatively deep U-shaped module according to the present invention.

As shown in FIGS. 1A and 1B, the Howard module is comprised of a main or rear wall panel 1 the height H of which is one story (8 feet) and the width $W_p$ of which is on the order of 8 feet or more. The thickness $t_w$ of the main panel 1 is defined between its rear face 4 and its interior face 5 and is described in the patent as being on the order of 6 inches. Extending from opposite ends of the main panel 1 are a pair of flanges 2 and 3, each again having a respective thickness $t_f$ of approximately 6 inches between respective interior faces 6 and 8 and exterior faces 7 and 9 thereof. The exterior width of the side flanges $W_f$ of a Howard panel is on the order 15 inches, thereby making its interior depth $D_I$ between the ends of the side flanges 2 and 3 and the interior face 5 approximately 9 inches. This extremely shallow interior depth (9 inches) of the Howard module effectively prevents the module from being capable of enclosing standard building appurtenances, so that, from an architectural design standpoint, the Howard module is impractical and unattractive.

Based upon the dimensions of the Howard module shown in FIGS. 1A and 1B and described in the Howard patent, the effective center of gravity C.G. of the module is located inside the main panel 1 and is separated from the outside face 4 thereof by approximately $4\frac{7}{8}$ inches. As will be described in detail below, because the center of gravity of the shallow module of Howard is located inside the rear wall 1 the Howard module is inherently unstable (for example, the Howard module is readily tipped over by moderate environmental forces, such as wind, applied to the interior face 5) and can be neither stored nor handled on the job site as a free standing module.

The deep configuration of the U-shape module of the present invention, shown in FIG. 1C, on the other hand, involves the use of a side wall 14 of substantial interior depth (14D=27) which results in a shifting of the center of gravity C.G. from the interior of the rear panel 12 to a distance D.C.G. outside of the rear panel 12 towards the area of bounded by the interior face 12-I the rear panel 12 and the side walls 14. This shift in the center of gravity C.G. increases the lever arm distance of the effective moment of the module with respect to a point-0 corresponding to the intersection of the outside face 12-0 of the rear panel and the horizontal surface upon which the bottom 18 of the module rests. The resulting increase in the moment (corresponding to the product of the weight of the module and the lever arm distance of the center of mass C.G. from the outside face 12-0) significantly increases the magnitude of force that must be imparted in a horizontal direction to the interior face 12-I of rear panel 12 to cause the module to tip. (A quantified comparison of the free-standing deep module of the present invention and the inherently unstable shallow module of the prior art (Howard) is detailed infra.)

The construction module according to the present invention is suitably reinforced by having conventional reinforcing members embedded therein. The reinforcing members may comprise conventional steel reinforcing rods and steel mesh embedded within the concrete in a manner which will be quite apparent to those skilled in the art. The module may also be prestressed if desired.

A plan view of a selected set of typical embodiments of the U-shaped module is shown in FIG. 2. It was noted previously that a relatively small number of module shapes or sizes provide for a wide flexibility in design. It has been found that three to five basic sizes of U-shaped modules can be associated to provide any desired shape or size of room or enclosure. The modules are shown in FIG. 2 being laid out on a common rectangular grid in order to more clearly demonstrate their relative dimensions and proportions. It can be seen that each module is dimensioned such that its length taken along the main panel 12 in the horizontal direction is substantially equal to a whole number multiple of a common grid or module dimension M. In like manner, the width of each module is also equal to a multiple of the common modular dimension M. For typical North American applications, this common module dimension M is 80 cm (32 inches). In other countries, the basic modular dimension may be 80 cm or may be based on a suitable metric multiple of about 90 centimeters. The 32 inch multiple was chosen because, as a flange length, it imparts free standing stability (by shifting the center of gravity outside the main panel) and also provides an architectural feature of completely enclosing most appurtenances and facilities, namely countertops, sinks, household equipment, office equipment, retail showcases etc. The modules shown in FIG. 2 have been laid out indicating a floor layout grid of 16 inches (in broken lines) to show a finer grid which may be used for design purposes. The distance between solid lines is the common modular distance or dimension M of 32 inches, noted above. Typically, the thickness of each of the main or rear panel 12 and the flanges or side walls 14 of a module is on the order of $4\frac{3}{4}$ inches.

The common rectangular grid dimensioned as a multiple of or as a division of the basic modular dimension M allows for relatively straightforward modular coordination at the design and construction stages. The dimensioning is done relative to the grid; therefore the grid provides the discipline, not a constraint.

With continued reference to FIG. 2, the smallest U-shaped module shown, designated 10A, has an overall length substantially equal to two times the basic module dimension, while its overall width is equal to the modular dimension M. Thus, its overall nominal length is on the order of 5 feet 4 inches, while its nominal overall width is on the order of 2 feet 8 inches. However, in practice, the modules are dimensioned such that there outer surfaces are typically spaced inwardly of the grid lines by a distance of about $\frac{1}{8}$ of an inch. Hence, in this instance, module IOA has an overall actual length of 5 feet $3\frac{3}{4}$ inches and an overall width of 2 feet $7\frac{3}{4}$ inches. The same considerations apply to each of the remaining modules illustrated. The thickness of the main panels and flanges of the several modules illustrated are the same in each case, typically being about $4\frac{3}{4}$ inches; however, the flanges are desirably provided with a small degree of draft of their inwardly facing major surfaces to allow for ease of stripping from the molds without affecting the basic "squareness" of the modular flanges relative to the main panel. A suitable radius or fillet 22 is also provided between the interior major surfaces of the flanges 14 and the main panel 12, to thereby provide added strength, a more pleasing appearance, and to provide for ease of cleaning the module surface, particularly in cases where the module is used as part of a kitchen or bathroom facility.

The relative proportions and dimensions of the modules shown in FIG. 2 are chosen primarily to satisfy architectural requirements while also providing each module with a substantial degree of lateral stability when standing on a level surface. The degree of lateral stability is such as to allow the modules to be positioned on a horizontal surface, each in a self-standing condition. As noted above, lateral stability is the ability of the module to resist a force acting on the interior face 12-I of the rear wall 12, tending to rotate or tip the module about an axis extending through the intersection of the exterior wall 12-0 and the bottom 18 of the module, shown at point 0 in FIGS. 1A and 1C. It has been found that the various forms of U-shaped modules 10A-10E shown in FIG. 2 and in the length and width proportions or ratios given therein possess the inherent characteristic of having their centers of masses (or centers of gravity) displaced from the interior face 12-I of the rear wall or main panel 12 to the open space between the side walls or flanges 14. By displacing the center of gravity outside of the rear wall 12, the modules possess sufficient self-standing capability so as to allow them to be erected on-site and to stand alone without the need for braces or side connection elements in heights of up to approximately 25 feet. In the most commonly used heights, namely one story or 8 feet, the U-shaped modules depicted in FIG. 2 possess a sufficient degree of resistance to tipping so as to satisfy normal safety standards. A sufficient degree of lateral stability is achieved when the ratio of the overall length of the module taken in the direction of the main panel 12 to the overall width of the module taken in the direction of the outside depth of the flange portions 14 and measured in the horizontal direction falls within the range of ratios depicted.

The substantial degree of lateral stability or free standing capability of the present invention is underscored by the results of tests carried out on the deep U-shaped modules 10A, 10B and IOC of the present invention shown in FIG. 2 and the shallow U-shaped panel of Howard shown in FIGS. 1A and 1B and described in the above-referenced patent. Each module was placed on a horizontal support surface in wind free conditions and a horizontal force was applied to the interior face of the rear panel of each module at a point 5 feet above the horizontal support surface midway between the side walls. It was found that a force of only 213 lbs. was required to overturn the Howard module, namely rotate it counter clockwise about point 0 shown in FIG. 1A. A similar application of force to the interior faces of the modules 10A, 10B and 10C of the present invention shown in FIG. 2 required respective values of 644 lbs., 669 lbs. and 694 lbs. to overturn the module. Moreover, it was found that the Howard modules are readily tipped over by a wind of only 38 mph (corresponding to a pressure input of 3.85 pounds per square foot) thus clearly requiring bracing during assembly of a building for the sake of safety. The modules of the present invention shown at 10A, 10B and 10C in FIG. 2, on the other hand, can withstand winds up to 93.5 mph, 79.6 mph and 72.0 mph, respectively; no bracing is required.

The modules shown at 10D and 10E of FIG. 2 have even greater stability than the modules shown at 10A, 10B and 10C as a result of the increase in depth of side walls 14.

Although, in the embodiments illustrated in FIG. 2, described above, the thickness of each of the main panels and flanges are typically on the order of 4¾ inches, as noted above, and the standard dimension M is given as being on the order of 32 inches, it is to be observed that such dimensions are not to be considered limitative of the invention but are merely practical dimensions from a standpoint of architectural an engineering considerations. The thicknesses of the rear and side walls may be greater or smaller than the 4¾ inch dimension given here. Preferably, the thickness is not less than three inches in order provide requisite mechanical strength and the ability to accommodate internal reinforcing rods, conduits, etc., to be described below. Moreover, the depths of the side walls and lengths of the rear walls may vary with respect to the modular dimensions given here. What is important in accordance with the present invention is that the interior depth of the side walls (namely between the ends thereof and the interior face of the rear panel) be sufficient to provide both an engineering stabilizing function (by providing a center of gravity which is outside of the rear wall) and an architectural function (of a depth sufficient to accommodate structural appurtenances and facilities).

Figure 3:
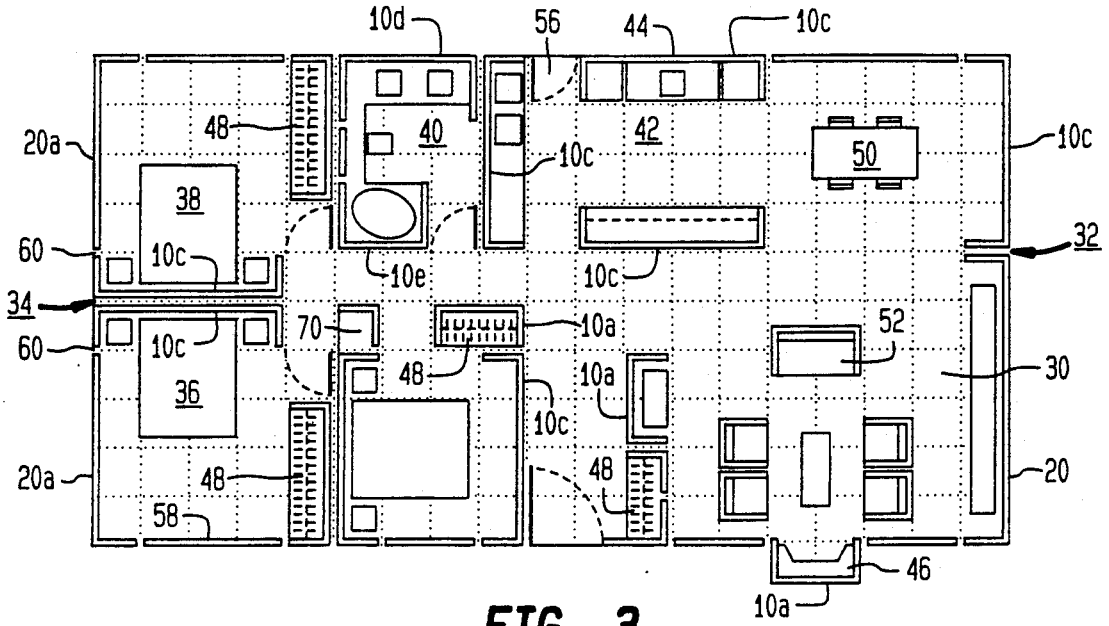
FIG. 3 shows a typical floor plan illustrating the positioning of the modules in a single story application.

FIG. 3 is a typical floor plan illustrating the positioning of the various modules depicted in FIG. 2 in a single story application. The modules are positioned on a horizontal surface 30 which in a typical case would be provided by a concrete slab on grade. For purposes of illustration, the horizontal surface 30 is shown as having an imaginary grid defined thereon consisting of two series of parallel lines intersecting one another at right angles, which lines are spaced apart by a distance corresponding to the common modular dimension M. A first group of the modules 10 are positioned relative to one another on the support surface 30 adjacent perimeter portions of such surface as to define portions of the side walls of the building. A further group of the modules are positioned on the support surface 30 interiorly of the perimeter portions to define at least portions of the interior partitions. An inspection of FIG. 3 will readily show how the various modules **10*a*, 10*b*, 10*c*, 20 etc. service to provide partial space enclosures to house or partly enclose the various facilities within the building construction. For example, end wall 32 of the structure is defined by a single 10*c* module together with two L-shaped modules 20*a*. The opposing end wall 34 is defined by a pair of L-shaped modules 20 in conjunction with back-to-back U-shaped modules 10*c*. These same two modules 10*c* also provide an interior wall between bedrooms 36 and 38. A bathroom facility 40 is defined in part by a module 10*c* located at the perimeter and a further module 10*e* which is interiorly disposed. The flanges of these last two mentioned modules 10*e* and 10*b* are directed generally toward a region lying intermediate such modules to define a substantial portion of the enclosure for bathroom 40. A partial enclosure for a kitchen facility 42 is provided by interiorly disposed modules 10*c* disposed in opposing relationship to a special module 10*c* disposed at the building perimeter. The flanges of these latter two modules are directed toward each other to provide a partial space enclosing function. It should also be noted here that module 10*c* is of a special construction in that it includes a rectangular window opening 44. A typical window opening is illustrated in dished lines in module 10 of FIG. 1. It might be noted here that modules 10** do not commonly require window openings to be formed therein. This is an exception which can be accommodated to satisfy a users' preference.

Normally, standard local windows and doors are set between modules. They are connected to the modules using standard on-site connection details and local practices. Fasteners for connecting windows and doors to concrete structures are very well known in the construction industry and need not be described further here. The placing of windows and doors adjacent to modules allows design flexibility for a greater variety of sized of openings than would be possible if they were cast into the modules for Erection Tolerances required. Consequently the system becomes an open system which responds to local user preferences, standard accoutrements and local practices and site conditions.

In another instance of a somewhat specialized use of a module, an exteriorly disposed fireplace and chimney arrangement 46 is defined by a further module 10. A conventional fireplace and chimney constructed on-site can of course be used, but the amount of on-site work is reduced by using a module in this fashion.

The remaining modules perform various types of space-defining and space-enclosing functions as, for example, in closets 48 which are provided with suitable add-on shelving and doors, with others of the modules providing simple space enclosures facing into the dining-room area 50 and the living-room area 52. These partial space enclosures may be used to house desks, book-cases, entertainment centers, built-in furniture and any other desired appurtenances. Still others of the modules, including portions of the modules already referred to, serve to frame and define doorway entrances and hallways, none of which need to be described in detail here.

As noted previously, the individual modules 10*a*, 10*b*, etc., as well as L-shaped modules 20, 20*a* being self-standing on the horizontal surface 30, do not require the provision of connector elements therebetween to achieve the required degree of structural stability. All that is needed between modules, either when they form part of the exterior wall or as interior bearing and dividing walls, is a suitable joint seal, which seal can employ standard industry techniques. If structural fasteners were required, the use of standard doors and windows between the modules would not be possible.

Figure 3A:
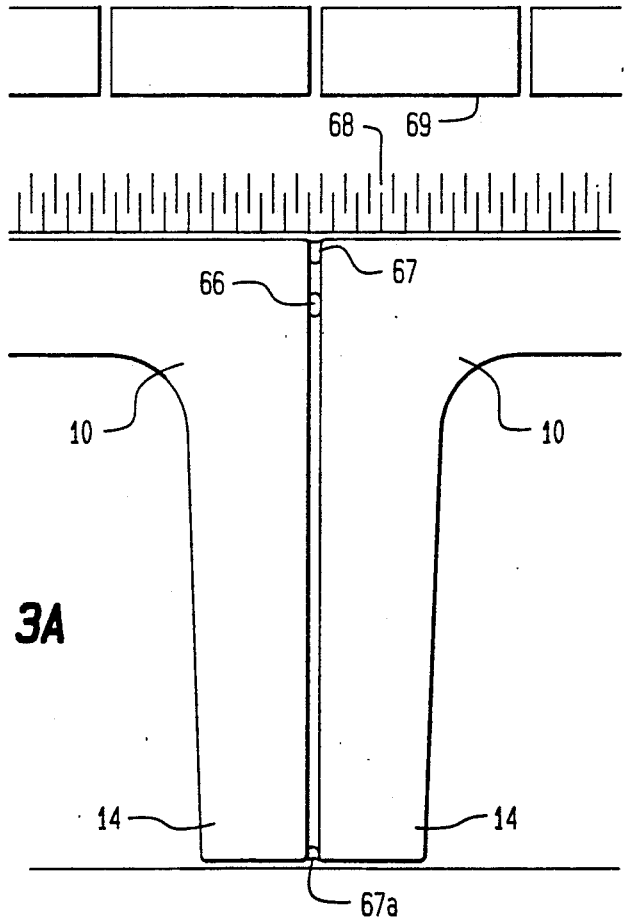
FIG. 3A is a plan view showing portions of adjacent modules and illustrating a joint sealing means therebetween.

FIG. 3A is a plan view illustrating a typical joint sealing means which can be used both in an exterior and an interior joint between adjacent modules 10. For the exterior seal the rain screen method may be employed which uses a flexible rain shield, such as a P.V.C. strip or bead 66 disposed in the small gap between the modules, in conjunction with an exterior caulking 67, both of which extend vertically along the joint. For the interior condition normal taping, plastering and sanding will result in a smooth finished joint 67*a*. The above basic form of joint seal can also be used in the joint configuration illustrated in FIGS. 4A and 4B.

Referring back to FIG. 3, this shows the use of a special L-shaped module 20' in conjunction with the flange of a regular U-shaped module to define a small closet 70. These special short L-shaped modules could be used in other instances as well. In manufacturing the L-shaped modules 20, 20*a* and 20', all that is required is that a block be placed in the mold which is used to manufacture the U modules, appropriate adjustments being made to the lay-out of the reinforcing members and the conduit system as will be hereinafter described. As noted previously, all of these modules may be case in an open steel mold, vibrated and trowelled thereby enabling the production of a high quality final surface finish. Thus, the surfaces of the modules exposed to the building interior can be simply painted or wallpapered as desired while the exterior surfaces may be left as is painted, providing a smooth stucco-like finish or the exterior can have any desired cladding of wood, brick or stone. Indeed for inexpensive buildings light weight concrete will provide some insulation without the need for add on. When additional cladding is incorporated, side wall insulation can be provided as required. The exterior surfaces of the modules at the perimeter of the building will be provided with a vapor barrier and a layer of insulation 68 (FIG. 3A), preferably a rigid insulation board. Any desired exterior siding 69 (FIG. 3A) can be applied over the insulation using techniques well known in the art.

This is in contrast to normal precast construction. Because precast is intended to be the exposed exterior finish, the mass is outside and the insulation is inside, which is the wrong place for maximum effectiveness. In contrast the modular system described places the mass inside because of the interiorly disposed finished surface, allowing the insulation to go outside where it achieves its full effectiveness. Interior insulation then dictates additional expensive interior finishing "sandwich" insulation cast in the concrete makes for difficult casting techniques.

In FIG. 3 it will be seen that the various modules are located such that their main panels 12 and their associated flanges 14 extend along predetermined ones of the grid lines and, having regard to the described modular dimensioning it will readily be appreciated that a commonly used spacing of adjacent modules located in this fashion is a distance equation to $M \times N$ . . . where M is a common modular dimension and N is a number equal to 0, 1, 2, 3 . . . . Some of the modules on the perimeter are also spaced apart by distances equal to $N \times M$ to provide spaces of common modular lengths for receiving door units 56, and window units 58. FIG. 3 also reveals how the interiorly disposed modules 10*a*, 10*b*, etc. are also spaced apart by distances equal to a multiple of the common modular dimension to provide hallways, doors openings and the like, each having a width based on the common modular dimension.

FIG. 3 demonstrates the kind of simple module coordination that can be achieved using a grid equivalent to the basic modular dimensions. In this instance the modules and all between-module spacings, either for windows, doors or passageways are of a modular dimension. This allows a builder to use door and window units of a size which are coordinated with the modular dimension. In construction it also achieves simplicity in lay-out, and erection.

Alternatively, depending upon user preferences or the sizes of local standard windows and doors the dimensioning can be done relative to the grid. However, it is to be understood that the invention is not limited to positioning modules either strictly on the grid or even relative to the grid. Rather the modules can be dimensioned with total freedom using any suitable form of layout. The grid based upon the modular dimension of 32 inches, or using a working layout grid of 16 inches if desired, merely provides a discipline for using the modules but is not a constraint.

Figure 4:
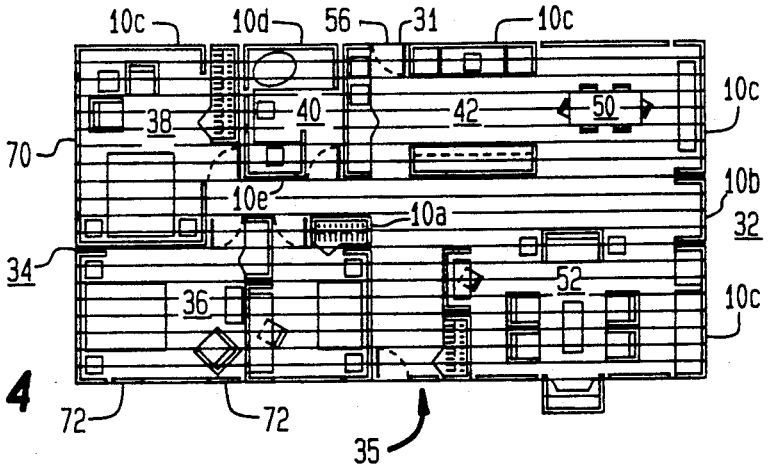
FIG. 4 is a is a top plan view of an alternative form of floor plan configuration for a single storey application.
Figure 4A:
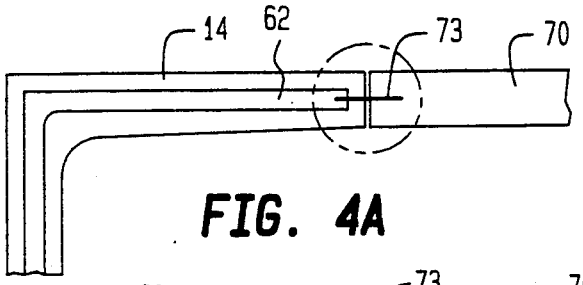
FIG. 4A and 4B are top plan and section views respectively of portions of the connection which may be used to join a straight wall panel to a module.
Figure 4B:
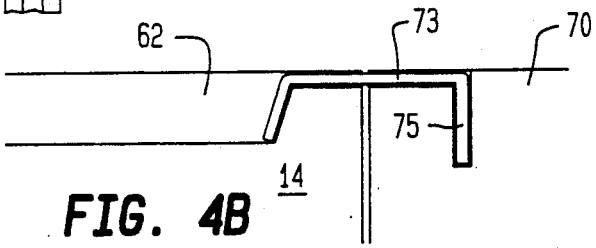

FIG. 4 is a top plan view of an alternative floor plan configuration particularly suitable for single story application. This floor plan is drawn on the 16 inch grid to illustrate the use of the finer screen which may be preferred at certain times when designing dwellings. The overall lay-out is somewhat similar to that of FIG. 3 in that the various modules 10*a*, 10*b*, etc. are laid out so that they extend along the various rectangular grid lines. Again, it should be realized that this is only a typical floor plan and that an almost infinite variety of arrangements and lay-outs can be adopted depending upon the end use requirements. One of the notable features of the lay-out of FIG. 4 is that it does not utilize any of the L-shaped modules 20. The U-shaped modules 10*a*, 10*b*, etc. are utilized throughout the lay-out to provide exterior walls and interior spacing enclosing partitions. It might be noted that the side wall 31 of the structure is provided with two of the previously described special modules 10*c* having a window opening formed therein and receiving a standard window unit. One of these special modules, as described previously, is utilized for the kitchen 42 while the other is used for the bedroom 38. It will also be noted that end wall 34 includes a flat in-fill panel 70 while front wall 35 of the building includes several in-fill panels 72, 74 etc. These in-fill panels may be connected to the adjacent modules utilizing the connection technique illustrated in FIGS. 4A and 4B. FIG. 4A shows a plan view of a ¾ inch rod 73 which ties the flat wall panel 70 to the flange 14. FIG. 4B is a section view showing the bent rod 73 having one downwardly angled end held in a raceway 62 (to be described hereafter) in the flange 14 while the other end of rod 73 is inserted in a ¾ inch insert which is part of the steel reinforcing of the wall panel 70. This device serves to hold the wall panel 70 in place until a roof assembly is put on, or, in the case of a multi-story structure, until the next floor slab is positioned on the upper ends of the modules.

Figure 4C:
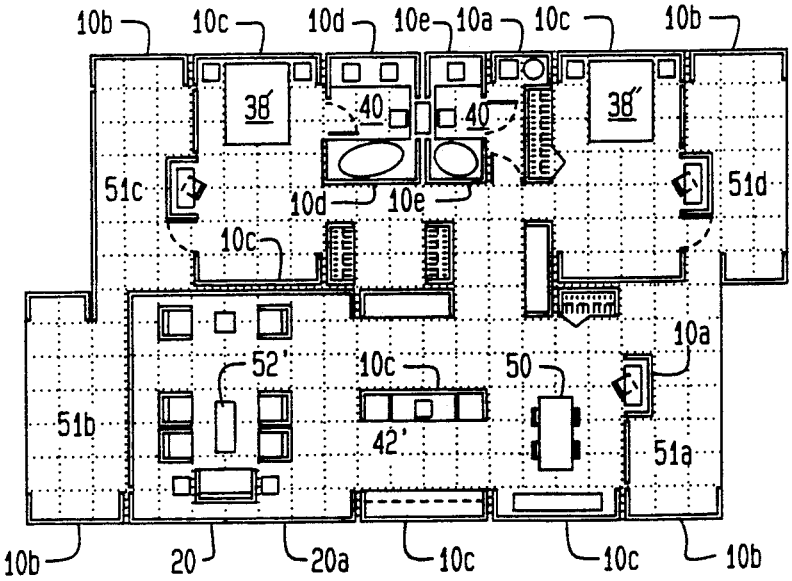
FIG. 4C is a top plan view of a typical floor plan configuration for an apartment unit.

FIG. 4C is a top plan view of a floor plan configuration suitable for apartment application. This floor plan again illustrates how the various modules 10*a*–10*e*, 20, 20*a* can be positioned to provide exterior walls and interior spacing-enclosing partitions. The layout provides a kitchen 41', dining-room 50', living-room 52', bedrooms 38' and 38'', bathrooms 40' and 400, numerous closets 48', as well as balcony areas 51*a* through 51*d*, together with various hallways, doorways, window openings etc., none of which need be described in detail here. FIG. 4C again illustrates the great flexibility of the modular system in providing virtually any desired lay-out as well as illustrating the volumetric spacing-enclosing function of the various modules.

Figure 5:
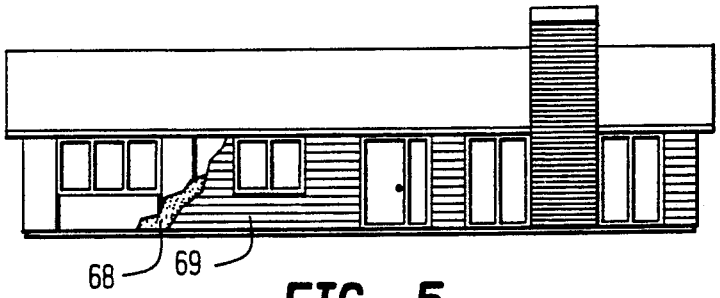
FIG. 5 is a frontal view of a typical single storey construction.

FIG. 5 is a frontal view of a bungalow utilizing the modular system and employing a conventional truss-roof structure. The truss-roof structure is supported directly upon the upper-most extremities of the various modules and is connected thereto by an industry standard connector means (not shown). A layer of insulating material 68 is applied to the exterior surfaces of the modules and is covered by an exterior surface of a suitable cladding material 69. It will be realized that in certain instances it may be desirable to provide the bungalow with a simple flat roof made from a slab or slabs of concrete laid directly upon the upper extremities of the self-standing modules. In this instance, as a result of the great weight of the slab concrete roof, no special connecting means for attaching it to the modules will be required other than mortar between the top of the module and the bottom of the slab.

Figure 6:
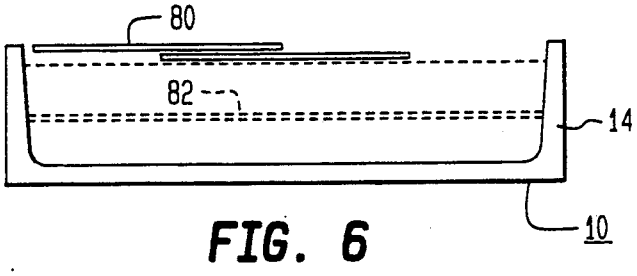
FIG. 6 is a top plan view illustrating the use of a U-shaped module as a closet.

FIGS. 6–9 illustrate the volumetric spacing-defining functions of the modules 10. FIG. 6 shows a module 10 providing a clothes-closet structure. A suitable support rail or trackway (not shown) extends between the outer extremities of flanges 14 and support a pair of sliding doors 80 in a generally conventional fashion. A clothes hanger bar 82 extends between the flanges 14. The connections between the module surfaces and the support rail and the bar 82 can be made utilizing connectors well known in the construction industry.

Figure 8:
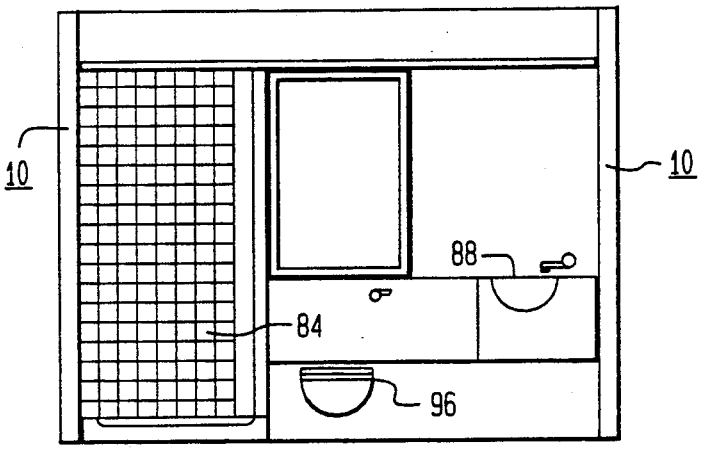
FIG. 8 is a vertical section taken along line 8—8 of FIG. 7.
Figure 7:
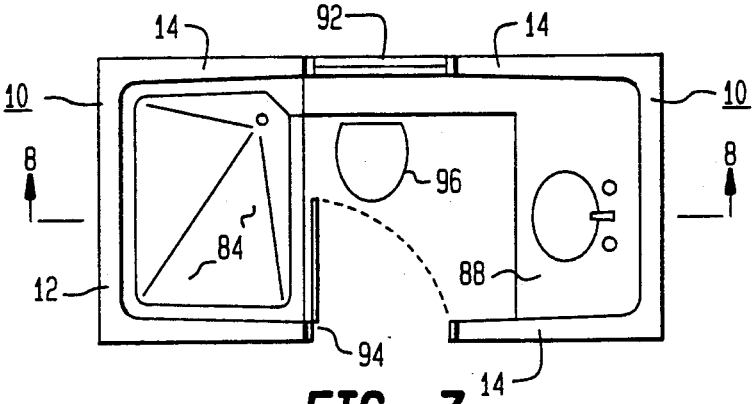
FIG. 7 is a top plan view illustrating the use of two opposed U-shaped modules in a bathroom facility.

FIGS. 7 and 8 illustrate the application of the modules to a bathroom facility. It will be seen here that a pair of modules 10 are arranged in opposed space relation with their associated flanges 14 being directed toward an intermediate region to define the bathroom enclosure. In modules for bathroom facilities it is quite common to employ at least one module which is a relatively "deep" variety, i.e. having a relatively low length to width ratio. The modules 10*d* and 10*e* as illustrated in FIG. 2 would be very suitable for this purpose. The construction illustrated shows a shower compartment 84 connected directly to one of the modules 10 and attached to the inwardly facing major surfaces of main panel 12 and flanges 14 using any suitable concrete fastener elements. It will be quite apparent that a bathtub may be substituted for the shower enclosure and connected directly to the module, again using standard connections. The opposing module 10 has a built-in vanity and wash-basin assembly 88. A suitable in-fill panel 92, which may contain plumbing pipes or, as shown, a window, is positioned intermediate the opposed ends of one pair of the flanges 14 while a door unit 94 is positioned intermediate the opposed ends of the other pair of flanges 14, the various connections etc. being made in a conventional fashion. A toilet assembly 96 is positioned on the floor of the bathroom area in a generally conventional fashion. It is noted here that the bathtub 84 and the vanity and washbasin 88 can be pre-installed in their respective modules at the factory thereby to reduce the amount of on-site work.

Figure 9:
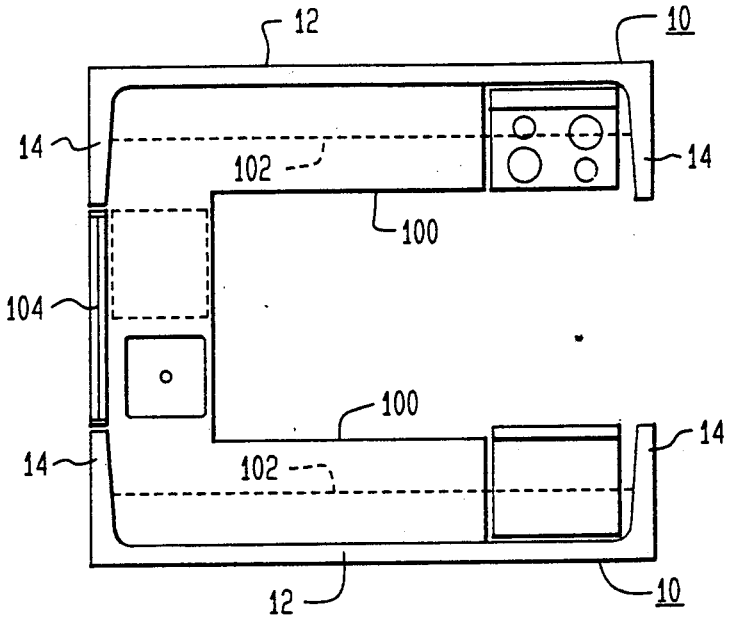
FIG. 9 is a top plan view illustrating the use of an opposed pair of U-shaped modules in a kitchen facility.

FIG. 9 is a plan view of a typical kitchen facility again illustrating the use of a pair of opposed modules 10 defining a space enclosure. As shown in FIG. 9, each of the modules 10 has a kitchen counter assembly 100 attached thereto and extending a selected distance along the major surfaces of the main panels 12. Suitable kitchen cupboard assemblies 10 (illustrated in phantom by broken lines) are disposed above the kitchen counters 100. Suitable spaces are provided between the ends of the counters 100 and the flanges 14 of the modules to receive standard stoves and refrigerators. The kitchen can of course be of a walk-through variety as illustrated in FIGS. 3 an 4 but in FIG. 9 the kitchen is closed by a window assembly 104 spanning the outer extremities of the flanges 14 of the opposed modules. The kitchen counters may be continued beneath the window assembly 104 or alternatively other kitchen facilities of any desired nature may be located in this position. The kitchen counters and cupboards 100, 102 may be prefabricated and installed in their respective modules 10 at the factory to reduce the amount of on-site labor. It bears nothing that in FIGS. 6–9 the flanges 14 of the modules are sufficiently deep to completely enclose the respective counters, appliances, vanities, shower compartments or tubs.

FIGS. 10, 10A and 10B, 10C illustrate two alternative methods to provide a prepowered module.

Figure 10:
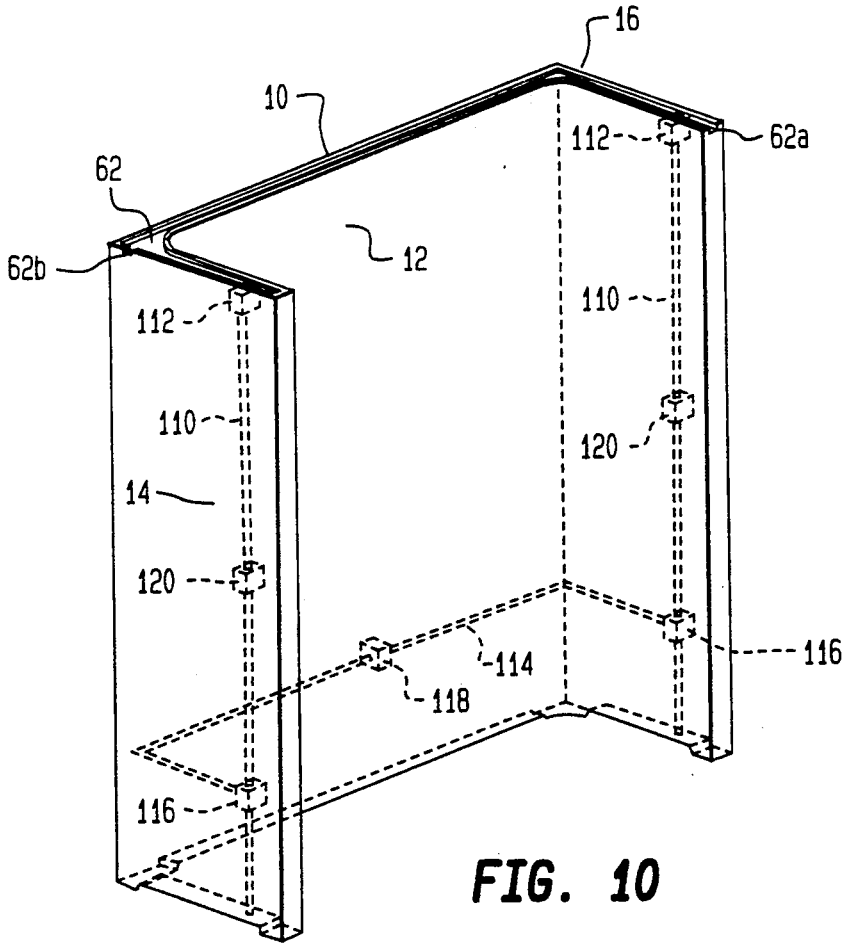
FIG. 10 is an isometric view of a module illustrating a top trough-like recess or raceway of also illustrating the interior conduit system.
Figure 10B:
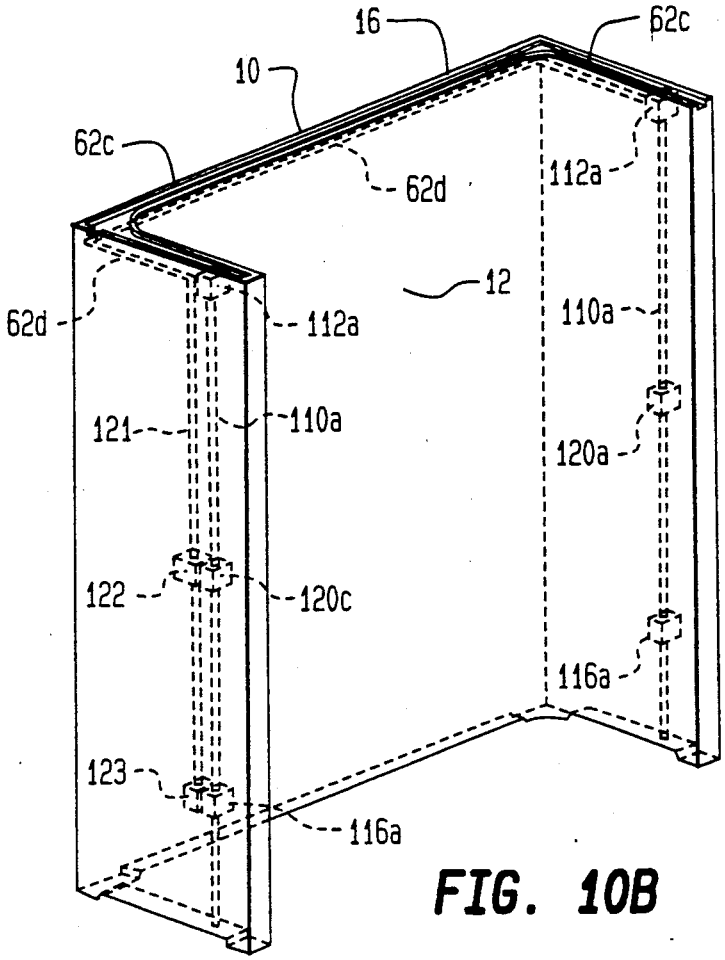
FIG. 10B and 10C are respectively an isometric view of the module and a fragmentary section of one of the module flanges illustrating an alternative wiring arrangement utilizing a top indentation and separate interior conduit system.
Figure 10A:
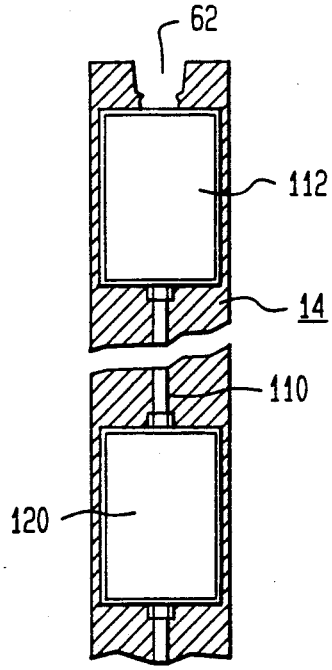
FIG. 10A is a fragmentary section view taken through one of the module and illustrating further the conduit and outlet/junction box arrangement.
Figure 10C:
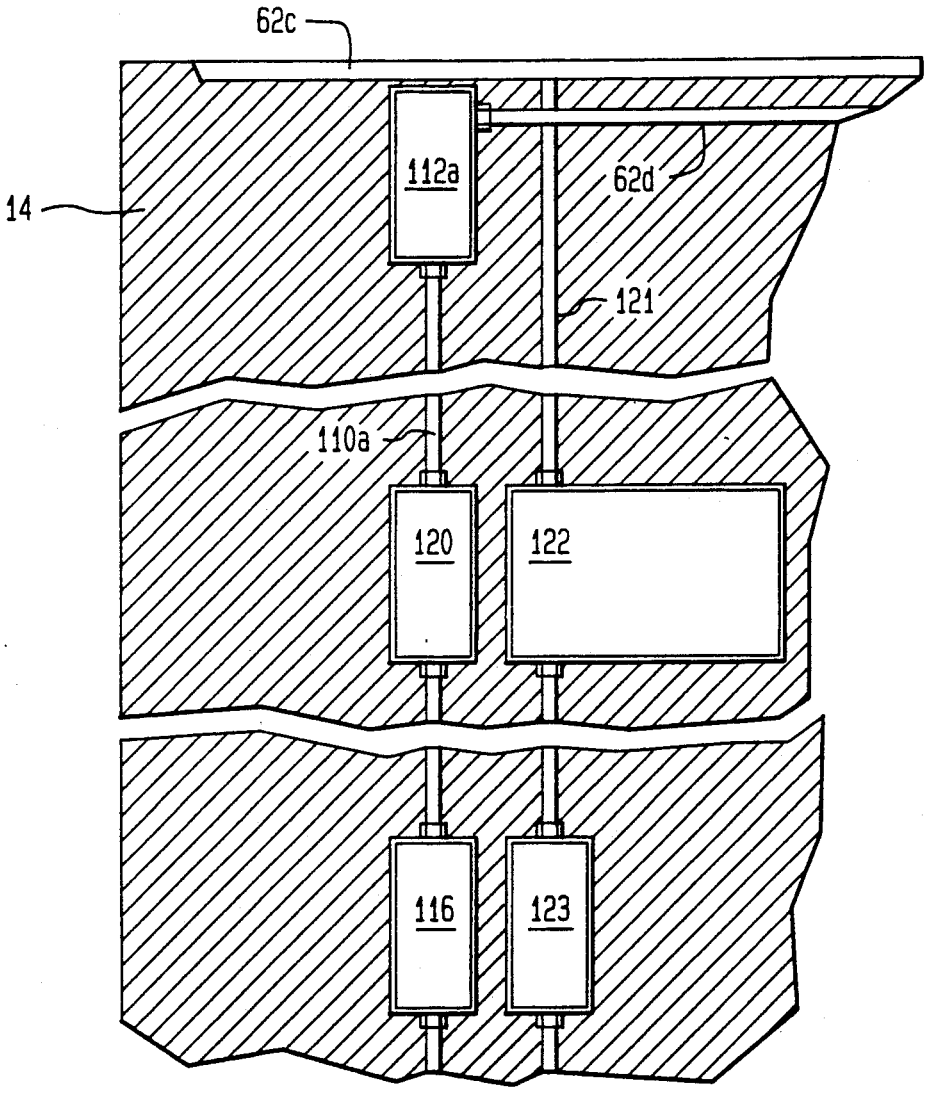

FIGS. 10 and 10A illustrate a top trough-like recess or raceway as well as an interior conduit and outlet/-junction box configuration. The top end wall 16 of the module is provided with a trough-like channel 62 which extends along the top end wall of both the main panel 12 and the flanges 14. A similar arrangement is used for the L-shaped modules 10 but is not illustrated here. The trough-like channel may be about 1¼ to 2 inches in depth and of a sufficient width to accommodate one or more electrical cables. It will be seen from FIG. 10 that the module flanges are each provided with a respective vertically extending conduit 110, with the top ends of each communicating with respective junction boxes 112, the latter in turn communicating with opposing end portions of channel or raceway 62. A traverse conduit 114 extends horizontally through the flanges 14 and the main panel 12, the opposing ends of conduit 114 entering junction boxes being in communication with the vertical conduits 110. The lower-most ends of conduits 110 extend downwardly below junction boxes 116 and open at the bottom ends of the module flanges. The horizontally disposed conduit 114 includes an outlet/- junction box 118 intermediate the opposed major surfaces of main panel 12 while the vertically disposed conduits 110 each include an associated outlet/junction box 120 disposed at a convenient height so as to be useable in connection with a wall switch or appliance output etc. The individual conduits and the outlet/junction boxes need not be described in further detail here since such devices are well known, per se, in the art and they will, in any event, be selected to satisfy the electrical and wiring codes in the jurisdictions in question. It will readily be seen from FIG. 10 that the various outlet/junction boxes are accessible from both of the opposed major surfaces of the main panel 12 and the flanges 14. This affords great flexibility in the design since, virtually regardless of how the individual modules are arranged in any particular building construction, the junction boxes will be readily accessible.

FIG. 10A shows the conduit 110 disposed approximately mid-way between the opposing major surfaces of the flange with the top junction box communicating directly with the top raceway 62. The outlet/junction box 120 is disposed such that its sides are spaced from the major surfaces of the flange by relatively short distances with relatively thin layers of concrete overlying the box. Thus, when the electrical contractor desires to gain access to this box, he can readily chip away the thin concrete cover, remove a side plate from the box and effect the necessary electrical connections.

The conduit and outlet/junction box arrangement illustrated in FIGS. 10 and 10A is not limited to use with power supply wiring but can be utilized as well to accommodate the wiring system for an intercom arrangement, cable television and/or telephone cables etc. The module can be prewired to again reduce the amount of on-site work.

It should be noted here that in the case where modules are closely adjacent to one another and one wishes to electrically connect one module to the other, it is a relatively simple matter to extend the trough or raceway 62 such that it communicates with the raceway 62 of the adjacent module by chipping away a portion of the edge of the raceway as illustrated in broken lines in FIG. 10 at **62*a* and/or 62*b*** following which the cables can extend from the raceway of one module into the raceway of the adjoining module. In the case where modules are isolated from other modules and it is desired to supply electrical power thereto, electrical cables are simply passed along the lintels over windows or through dropped ceiling spaces of the structure one module to the next.

FIGS. **10*b* and 10*c* illustrate an alternative method of providing a prepowered module. The difference in application is that electrical wiring proceeds primarily within the conduit network in the module, while the telephone and/or intercom is carried in the top channel. It provides for more strict separation of the two systems. The top end wall 16 of the module is provided with a cast in channel 62C of about ⅜ inch of depth and about 11/2 to 1¾ inches in width designed to receive cable for telephone and intercom communications FIGS. 10*b* shows that the channel 62*c* is in communication with a conduit 121 which in turn is linked to a junction/outlet box 122 and then with a junction/outlet box 123**. This conduit and junction/box assembly provide for access to telephone and internal intercom wiring.

FIG. **10*b* shows a transverse conduit 62*d* extending in the horizontal direction through flanges 14 as well as through the main panel 12, the opposing ends of conduits 62*d* entering into junction boxes 112*a* disposed in the respective flanges and the latter junction boxes being in communication with a set of vertical conduits 100, containing further junction boxes 120*a* and 116*a***.

A further transverse conduit, like 114 of FIG. 10 could be included if desired (not shown). The conduit and the outlet/junction boxes are, as referred to earlier, known in the art and will be selected from local practices to meet local requirements. Furthermore, the various outlet junction boxes are again accessible from both of the opposed major surfaces of the flanges 14, with only relatively thin layers of concrete overlying the boxes to assure simple access. Again the modules can be prewired to reduce the amount of on-site work.

Again in this case where the modules are closely adjacent to one another and the electrician wishes to electrically connect one module to the other, it is relatively simple to chip away the thin concrete covering junction boxes **112*a* and interconnect between the two junction boxes. In this case the telephone or intercom wiring as the channel 62*c* extends out of the exterior surface of the flanges 14 parallel with the main panel 10**, the opening is already provided and merely needs to be closed with a dab of plaster.

FIG. **10*c* shows the junction box 112*a*, and conduit 110*a* and conduit 121. conduit 121 communicates with channel 62*c*. Junction box 112*a* communicates with conduit 62*d***. (shown in dotted lines)

As in the other shown application in the case where modules are isolated from one another and it is desired to supply electric power or communications thereto, cables are passed along lintels or dropped ceiling connecting one module to the next.

Figure 11:
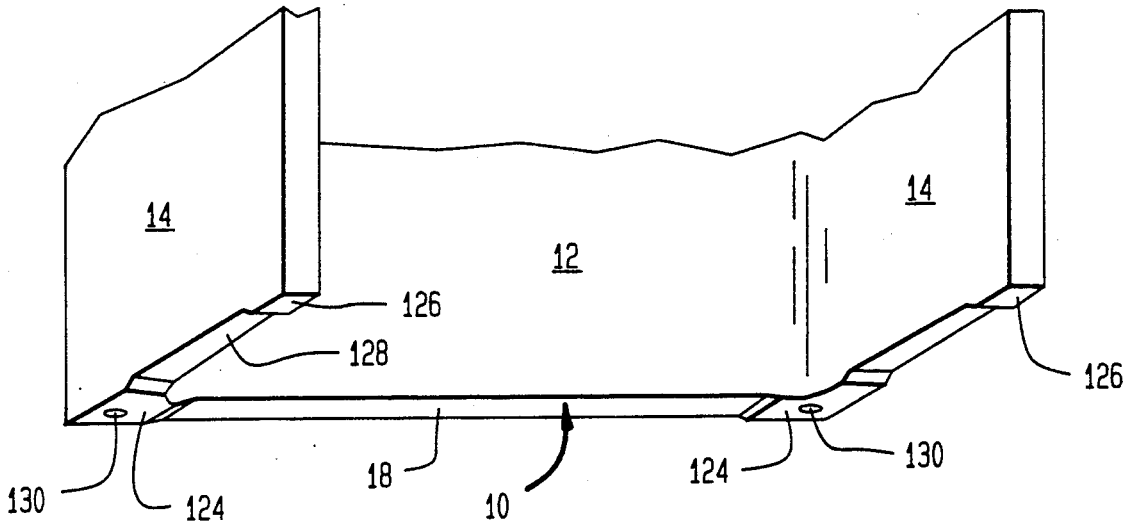
FIG. 11 is a further isometric view of a U-shaped module illustrating the bottom end surfaces of same and showing particularly the bearing pads and apertures for receiving a centering insert.
Figure 12A:
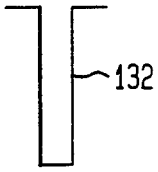
FIGS. 12A through 12E illustrate the various stages in the installation of a module levelling and centering device to a floor upon which a bearing pad of a module is subsequently positioned.
Figure 12B:
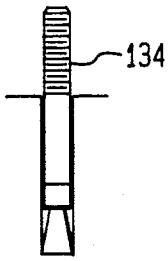
Figure 12C:
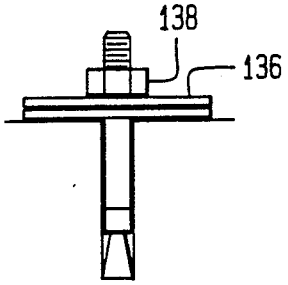
Figure 12D:
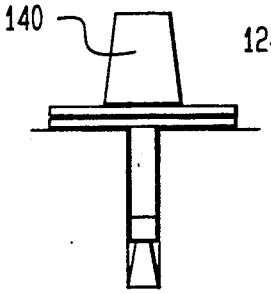
Figure 12E:
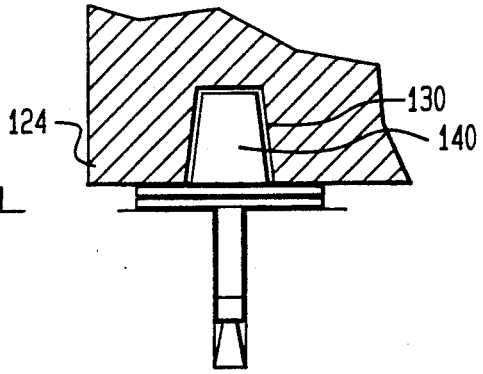

FIG. 11 shows the bottom end wall of the module 1 provided with a plurality of integrally formed bearing pads 124, 126, spaced apart along the main panel 12 and the flanges 14. The bearing pads 126 are disposed adjacent the free outer end portions of flanges 14 while bearing pads 124 are common to both one flange and the main panel 12. The elongated recessed regions 128 extending between the bearing pads 124, 126, provide room for a grouting compound to be inserted between the module and the floor on which it is standing to satisfy various codes relating to fire, water and insect resistance, as well as to improve the structural stability of the upright module. Each of the bearing pads 124 is provided with a suitable sized aperture 130 arranged to receive a portion of a self-levelling and self-centering arrangement. Where a module having a L-shaped configuration is used, this will also be provided with bearing pads similar to those described above for the purpose of providing essentially the same function.

The self-levelling and self-centering arrangement is illustrated in FIG. 12 which shows the various steps in the procedure. The first Step A is to drill a hole 132 of the appropriate depth and diameter in the concrete slab at a preselected location. In Step B a stud-like insert 134 is then driven into the hole with its upper threaded end projecting above the floor surface. In step C, a transit or level is used in order to determine the number of shims 136 required to provide a level support for the module. A nut 138 is then applied to the insert. In step D. a frusto-conically shaped centering element, 140, preferably of plastic material, is positioned over the nut. The module is then lowered into its final position with the centering element 140 entering into the aperture 130 provided in the associated bearing pad 124, 126. Shims (not shown) may also be positioned beneath the bearing pads 126 as required to achieve a level support for the module.

Figure 13A:
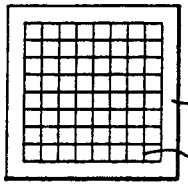
FIGS. 13A through 13E illustrate a typical module positioning and erection sequence.
Figure 13B:
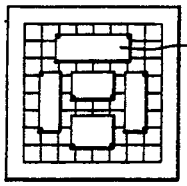
Figure 13C:
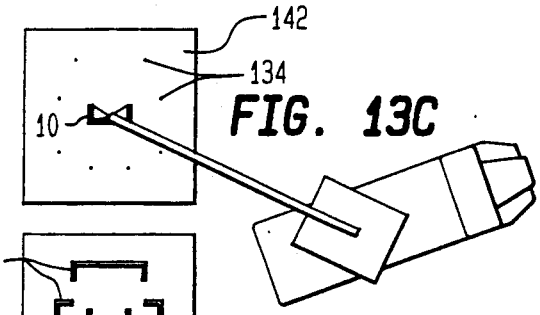
Figure 13D:
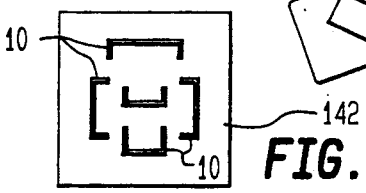
Figure 13E:
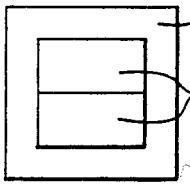

The method for erecting the modules is illustrated in FIGS. 13A–13E. With reference to FIG. 13A, the floor slab 142 is provided, which may be poured on the site or alternatively may comprise a precast slab or slabs of a conventional nature. The square grid pattern 144 is then laid out on the floor and the module locations are marked. With reference to FIG. 13B, a module template 146 is then positioned at each of the desired locations, such template being used to enable the holes 132 to be accurately drilled at the required locations, following which the stud-like inserts 134 are driven in. A transit or level is used to determine the number of shims required at the bearing pad locations. The various centering inserts 140 are then applied following which the module positioning stage is reached, reference being had to FIG. 13C. It might be noted at this point that the module is provided with lifting hooks anchored in suitably located apertures (not shown) positioned in its top end wall such that when the module is lifted up its hangs plumb. Thus, the lifting device shown in FIG. 13C lifts the module upwardly and then swings the module 10 to a position directly over its preassigned location on the floor following which it is lowered, being carefully guided over the last stage such that the conically shaped centering inserts 140 enter into the apertures 130 in the module bearing pads with the module ultimately seating firmly on the prepositioned levelling shims. The module is thus very accurately positioned levelling shims. The module is thus very accurately positioned and levelled at its desired location. This procedure is repeated until the desired array of modules is positioned on the floor, as illustrated in FIG. 13D, following which a roof structure or alternatively a flat set of slabs 150 as shown in FIGS. 13E are positioned over the upper extremities of the modules for support thereby.

Figure 14:
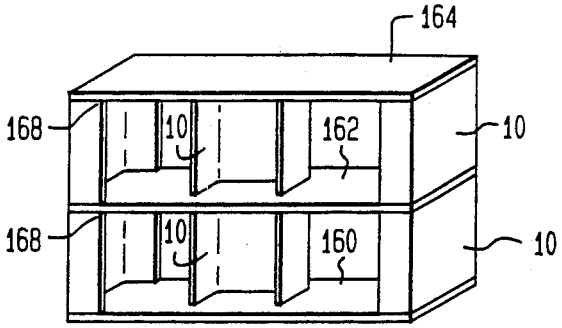
FIG. 14 is a simplified isometric representation of a two-story building.

It is to be emphasized here that virtually all of the construction techniques and structural arrangements previously described in conjunction with single story arrangements are also applicable to multi-story structures. Thus, in FIG. 14, the support for the first story comprises a horizontal footing 160 of conventional construction. All of the modules 10 on both stories are of the same height. The modules of the first story are supported on the horizontal floor slab 160 and serve to support on their upper extremities a further horizontal floor 162. Floor 162 comprises the support for the modules 10 of the second story with the upper extremities of the modules 10 of the uppermost story supporting a suitable roof structure which, as illustrated in FIG. 14, is a flat slab roof 164. The load of the horizontal floor and roof slabs etc. is thus carried downwardly to the lower-most floor or footing via the modules including both the modules positioned around the perimeter and those positioned interiorly of the perimeter. The lower ends of the modules are secured to their associated floor slabs by means of the inserts 134 previously described while industry standard moment connections are provided at points 166 and 168 between the upper ends of the perimeter modules and the floor slab or roof slab positioned thereon. A multi-story building structure as shown in FIG. 14 can thus be quickly erected story-by-story, until the desired height is reached. Modules can be stacked on intervening floors up to their maximum bearing capacity. The number of floors permitted depends on the span length of the floor slabs, the live loads expected and the type of connections provided. These follow normal engineering and job considerations.

Figure 15:
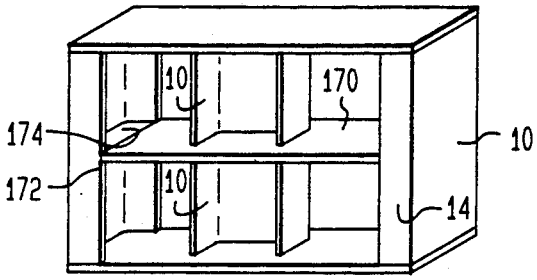
FIG. 15 illustrates a two-story structure wherein at least certain of the exterior modules extend the full height of the building with the peripheral edges of the floor being supported thereby with further modules positioned interiorly of the building structure.

A modified configuration is shown in FIG. 15. In this configuration, the modules 10 which are positioned at the perimeter portions extend the full height of building. A floor structure 170 is disposed at each level of the building and its peripheral edges are supported by the full height modules at the perimeter. The modules 10 which are located interiorly of the perimeter serve to support the remaining interiorly disposed portions of the floor structure at each level of the building and to carry these loads down to the bottom floor or footing. Standard angle brackets 712 are utilized to attach the perimeter portions of the floor 170 to the extremities of the flanges 14 of the full height modules. This configuration requires the use of additional in-fill floor panels 174 to bridge the gap between the edge of floor and the main panel 12 of each full height module. These panels can be prefabricated and inserted in place and held or secured to the module with standard angle connectors, or alternatively such slabs can be poured in place and secured by suitable reinforcing bars and other means well known in the industry.

Figure 16:
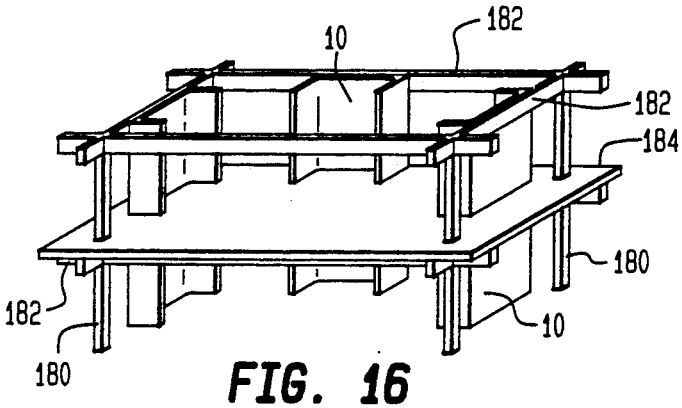
FIG. 16 illustrates the use of the modules in a structure incorporating traditional beams, columns and floors.

Another variant is shown in FIG. 16 which shows a conventional support structure comprising poured in place or precast vertical columns 180, and horizontally disposed beams 182 supported by the columns at each level of the building and serving to support conventional reinforced concrete floor slabs 184. A series of exterior modules defining the side walls of the buildings are attached to and supported by the perimeter portions of the floors 184 while the interiorly disposed modules are supported on the floors thereby to define the interior partitions and volumetric enclosures for facilities utilizing any desired floor plan or lay-out. Essentially the same technique can be used with steel floor assemblies. Structural connections between the modules and the parts of the building to which they are connected can vary widely using accepted industry standard techniques. It is believed that the above illustrations will show the great flexibility of the modular building construction provided by the present invention; those skilled in this art will readily be able to visualize other applications of the modular structure in the light of the foregoing illustrative examples.

It will be understood that numerous changes and modifications can be made to the embodiments described herein without departing from the spirit and scope of this invention.

What is claimed:

1. In a building construction having a horizontal support surface, a plurality of construction modules vertically positioned thereon in free-standing relation, each module comprising a precast concrete monolithic unit of rectangular outline in elevation and being defined by a rectangular planar main panel having at least one flange extending outwardly therefrom at generally a right angle thereto and extending the full height thereof, the main panel and said at least one flange each defining respective generally parallel pairs of opposed major sir faces, the ratio of the overall length of each module taken along its main panel to its overall width taken along said at least one flange, both as measured in the horizontal direction, being such that said modules possess sufficient lateral stability as to eliminate the need for side connection elements between adjacent modules, with said modules either singly or in combination defining space enclosures for housing or enclosing appurtenances or facilitates within the building construction; each of said module also defining a top end wall and a bottom end wall, each top end wall being provided with a trough-like channel which extends therealong and is in communication with at least one preformed elongated conduit extending within the module, said conduit, in turn, communicating with at least one outlet/junction box formed within the module, the channel, conduit and box being adapted to accommodate an electrical wiring system or communication wiring system, said bottom end wall of each module being provided with a plurality of integrally formed bearing pads which are spaced apart along the main panel and said at least one flange, levelling inserts disposed between some of said bearing pads and support means on which the modules are positioned to compensate for uneveness in the horizontal support surface, and locating elements extending between at least certain of the bearing pads and said support means and acting to locate said modules at predetermined horizontal locations on said support means.

2. The construction of claim 1, wherein each said module includes a spaced pair of flanges connected to its main panel at respective side edges thereof to define a generally U-shaped outline in plan.

3. The construction of claim 1, wherein at least one pair of said modules is arranged in opposed spaced relation to one another with their associated flanges being directed toward a region lying intermediate such pair whereby to define an enclosure for a room sized facility.

4. The construction of claim 3, wherein said opposed pair of modules define a kitchen facility, at least one of said modules having a kitchen counter assembly attached thereto and extending a selected distance along that major surface of the main panel which faces inwardly of the space enclosure defined by said module.

5. The construction of claim 3, wherein said opposed pair of modules define a bathroom facility, one of said modules having a bathtub, or shower, and/or sink and vanity counter facility attached thereto and disposed with the space enclosure defined by the U-shaped member.

6. In a building construction having a multiplicity of side walls and a plurality of interior partitions the combination of:

(a) a plurality of upright free-standing construction modules each comprising a precast concrete monolithic unit of rectangular outline defined by a rectangular main panel having at least one flange extending laterally outwardly therefrom and extending substantially the full height of the main panel;

(b) support means on which the construction modules are positioned;

(c) a first group of said modules being positioned relative to one another on the support means adjacent perimeter portions of the building construction to define portions of the side walls of the building construction;

(d) and a second group of said modules being positioned on said support means interiorly of said perimeter portions to define at least portions of said interior partitions;

(e) said modules of the first and second groups being positioned on said support means to provide space enclosures whereby to house or enclose appurtenances and facilities within the building construction;

(f) said modules each being provided at their lower extremities with a plurality of integrally formed bearing pads which are spaced apart along the main panel and said at least one flange, levelling inserts disposed between certain of said bearing pads and the support means on which the modules are positioned, and insert means extending between at least certain of the bearing pads and said support means and acting to positionally locate said modules at predetermined positions on the support means.

7. In a building construction having a multiplicity of side walls and a plurality of interior partitions the combination of;

(a) a plurality of upright free-standing construction modules each comprising a precast concrete monolithic unit of rectangular outline defined by a rectangular main panel having at least one flange extending laterally outwardly therefrom and extending substantially the full height of the main panel;

(b) support means on which the construction modules are positioned;

(c) a first group of said modules being positioned relative to one another on the support means adjacent perimeter portions of the building construction to define portions of the side walls of the building construction;

(d) and a second group of said modules being positioned on said support means interiorly of said perimeter portions to define at least portions of said interior partitions;

(e) said modules of the first and second groups being positioned on said support means to provide space enclosures whereby to house or enclose appurtenances and facilities within the building construction;

(f) a plurality of said modules each being provided at their upper extremities with a trough-like channel which extends along an upper end wall of the module between the major surfaces of the main panel and said at least one flange, said trough-like channel being in communication with at least one preformed elongated conduit extending within the module, said conduit, in turn, communicating with at least one recess formed in the module between the major surfaces thereof, the channel, conduit and recess being adapted to accommodate an electrical wiring system or communication wiring system, and wherein all of said modules are each provided at their lower extremities with a plurality of integrally formed bearing pads, which are spaced apart along the main panel and said at least one flange, levelling inserts disposed between certain of said bearing pads and the support means on which the modules are positioned, and insert means extending between at least certain of the bearing pads and said support means and acting to positionally locate said modules at predetermined positions on the support means.

* * * * *